US010539108B2

(12) United States Patent
Guerrassi et al.

(10) Patent No.: US 10,539,108 B2
(45) Date of Patent: Jan. 21, 2020

(54) FUEL RAIL FOR INJECTION SYSTEM

(71) Applicant: DELPHI TECHNOLOGIES IP LIMITED, St. Michael (BB)

(72) Inventors: Noureddine Guerrassi, Vineuil (FR); Junmei Shi, Trier (DE); Didier Robart, Luxembourg (LU); Jean-Romain Benoit, Metz (FR); Pierre Fougairolle, Messancy (BE)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/751,336

(22) PCT Filed: Jul. 28, 2016

(86) PCT No.: PCT/EP2016/068098

§ 371 (c)(1),
(2) Date: Feb. 8, 2018

(87) PCT Pub. No.: WO2017/025348

PCT Pub. Date: Feb. 16, 2017

(65) Prior Publication Data

US 2018/0238288 A1 Aug. 23, 2018

(30) Foreign Application Priority Data

Aug. 10, 2015 (GB) ..... 1514053.6

(51) Int. Cl.
*F02M 55/02* (2006.01)
*F02M 63/02* (2006.01)

(52) U.S. Cl.
CPC ..... *F02M 63/0225* (2013.01); *F02M 55/025* (2013.01); *F02M 2200/247* (2013.01); *F02M 2200/315* (2013.01)

(58) Field of Classification Search
CPC .. F02M 55/02; F02M 55/025; F02M 63/0225; F02M 63/025; F02M 2200/315
(Continued)

(56) References Cited

U.S. PATENT DOCUMENTS 6,276,336 B1 8/2001 Krger et al.
6,904,894 B2 6/2005 Serizawa et al.
(Continued)

FOREIGN PATENT DOCUMENTS

DE 102007048495 A1 4/2009
DE 102011016168 A1 10/2012
(Continued)

OTHER PUBLICATIONS

Taudt, EP 1 256 713 A2 (Englisht translation) Nov. 2002 (Year: 2002).*

*Primary Examiner* — Erick R Solis
(74) *Attorney, Agent, or Firm* — Joshua M. Haines

(57) ABSTRACT

An arrangement for supplying high pressure fuel to a plurality of fuel injectors includes a housing defining a fuel chamber. The chamber is provided with a flow inlet from a high pressure fuel source and forms a first portion of flow path of the fuel, the chamber being fluidly connected to a conduit providing a second portion of flow path. The conduit has a plurality of outlets adapted to provide flow of high pressure fuel from the chamber via the conduit to a corresponding plurality of injectors via respective first outlet flow conduits. The second portion of flow path is substantially narrower than the first flow path, and includes a pressure sensor located in or adjacent to the conduit.

6 Claims, 17 Drawing Sheets

(58) Field of Classification Search
USPC ..... 123/456, 457, 468
See application file for complete search history.

(56) References Cited

U.S. PATENT DOCUMENTS

| | | | | |
|---|---|---|---|---|
| 7,422,001 | B2 * | 9/2008 | Kaneko | F02M 55/02 123/456 |
| 7,827,962 | B2 * | 11/2010 | Weizenauer | F02M 55/025 123/456 |
| 8,100,111 | B2 * | 1/2012 | Stingele | F02M 55/025 123/447 |
| 8,251,047 | B2 | 8/2012 | Kannan et al. | |
| 8,402,947 | B2 | 3/2013 | Kannan et al. | |
| 2002/0043249 | A1 * | 4/2002 | Lee | F02M 55/025 123/456 |
| 2010/0199951 | A1 | 8/2010 | Cinpinski et al. | |
| 2014/0216409 | A1 | 8/2014 | Katsura | |

FOREIGN PATENT DOCUMENTS

| | | | | |
|---|---|---|---|---|
| EP | 1 256 713 | A2 * | 11/2002 | F02M 55/02 |
| EP | 1256713 | A2 | 11/2002 | |
| JP | 3291949 | B2 | 6/2002 | |
| JP | 2007071152 | A | 3/2007 | |
| JP | 1212752 | B2 | 1/2009 | |
| JP | 2012097690 | A | 5/2012 | |

* cited by examiner

FUEL RAIL FOR INJECTION SYSTEM

CROSS REFERENCE TO RELATED APPLICATIONS

This application is a national stage application under 35 USC 371 of PCT Application No. PCT/EP2016/068098 having an international filing date of Jul. 28, 2016, which is designated in the United States and which claimed the benefit of GB Patent Application No. 1514053.6 filed on Aug. 10, 2015, the entire disclosures of each are hereby incorporated by reference in their entirety.

FIELD OF THE INVENTION

This disclosure relates to fuel injection systems and an arrangement to supple fuel under pressure to one of more fuel injectors. It has particular application to improved accuracy of fuel injection quantity control by measuring the injection duration and fuel pressure drop using aspects of the invention.

BACKGROUND

A standard technique for injection quantity control in fuel injection systems is based on the varying the drive pulse to an actuator in an actuator controlled valve of a fuel injector; i.e. varying the actuator electrical charging time duration. Typically correlation maps between injection quantity and the electrical charging time for various injection pressures over the entire engine operation load map are calibrated in advance and stored in an engine ECU.

With introduction of increasingly tightened emission and CO2 regulations, more precise injection quantity control method is needed. The main demands are to correct injector part-to-part deviation and the injection life-time drift for each injector.

There have been a number of methods and patents published to provide solutions to the above mentioned problem using various techniques. The most simple way is to use the pressure difference value before and after injection as a feedback signal to control the injection quantity, see e.g., US 2010/0199951A1 and US 2014/0216409 A1. This method is based on the principle of fuel compressibility. The injection quantity, namely the quantity released from a closed system with a constant volume, is proportional to the system pressure drop. Such methods can use the existing rail pressure sensor to get the pressure signal for control and thus does not require an additional pressure sensor and no additional modification of the component and system architecture. However, limited by sensor accuracy, ECU resolution accuracy, this method is not accurate enough for low injection quantity control.

For low injection quantity, esp. for pilot injection quantity control, the method based on injection duration is more accurate. For example, DE102011016168 A1 2012-10-11 proposes to detect the needle opening and closing from the solenoid signal. The electric conductivity has a sudden change when the contact status between the needle and the injection nozzle seat changes. This signal change can be used for needle opening (injection start) and needle closing (injection ending) detection. There are several problems with this. If the needle is not strictly co-axial to injector housing during the closing, big detection error can occur and make the control to lose precision. In addition, there is a requirement of expensive seat area coating to avoid life time detection drift caused by seat erosion.

In alternative methodologies pressure sensors are integrated inside an individual injector or alternatively in the fuel passage pipes between the rail and the individual injector. This solution however means that a pressure sensor needs to be utilized for each injector compared to the standard FIE system, and consequently increases the system cost and technical complexity of the injector design.

Patent publications based on injection control by measuring pressure include US 2010/0199951 which uses the rail pressure drop to control fuel injection quantity and US 2014/0216409 which uses rail pressure to control delta quantity of fuel injected.

It is an objective of the invention to overcome these problems.

STATEMENT OF THE INVENTION

In one aspect is provided an arrangement for supplying high pressure fuel to a plurality of fuel injectors including a housing defining a fuel chamber, said chamber provided with a flow inlet from a high pressure fuel source and forming a first portion of flow path of the fuel, said chamber being fluidly connected to a conduit providing a second portion of flow path, said conduit having a plurality of outlets adapted to provide flow of high pressure fuel from said chamber via said conduit to a corresponding plurality of injectors via respective first outlet flow conduits, wherein said second portion of flow path is substantially narrower than said first flow path, and including a pressure sensor located in or adjacent to said conduit.

The said housing and chamber may comprise a common rail.

The said conduit may be formed integral within said common rail.

The conduit may be formed as a section of said common rail with a narrower cross section than the main/remaining portion of common rail.

The said conduit may be formed as a pipe.

The said pipe or section of common rai forming said conduit have a substantially narrower cross section than said chamber or remaining portion of common rail.

The said common rail may define an elongate chamber having a circular cross sectional, the diameter of which is which is substantially larger than the conduit.

The flow path may be formed as a section of the common rail at one end having a reduced diameter or cross-section.

The said conduit may be formed as a toroidal pipe.

Said chamber may include a plurality of respective second flow conduits for corresponding fuel injectors each fluidly connected with respective first outlet flow conduit and forming a confluence therewith.

So effectively is provided an arrangement for a fuel system comprising a common rail adapted to supply fuel via a plurality of outlets to a plurality of fuel injectors comprising a housing defining a first chamber volume with an inlet to receive fuel from a pressurised fuel source, and a second chamber or volume including said plurality of said outlets, where said second chamber has a cross sectional area which is substantially narrower than said first chamber; said second chamber including a pressure sensor.

BRIEF DESCRIPTION OF DRAWINGS

The invention will now be described by way of examples and with reference to the following figures of which.

DETAILED DESCRIPTION

Figure 1:
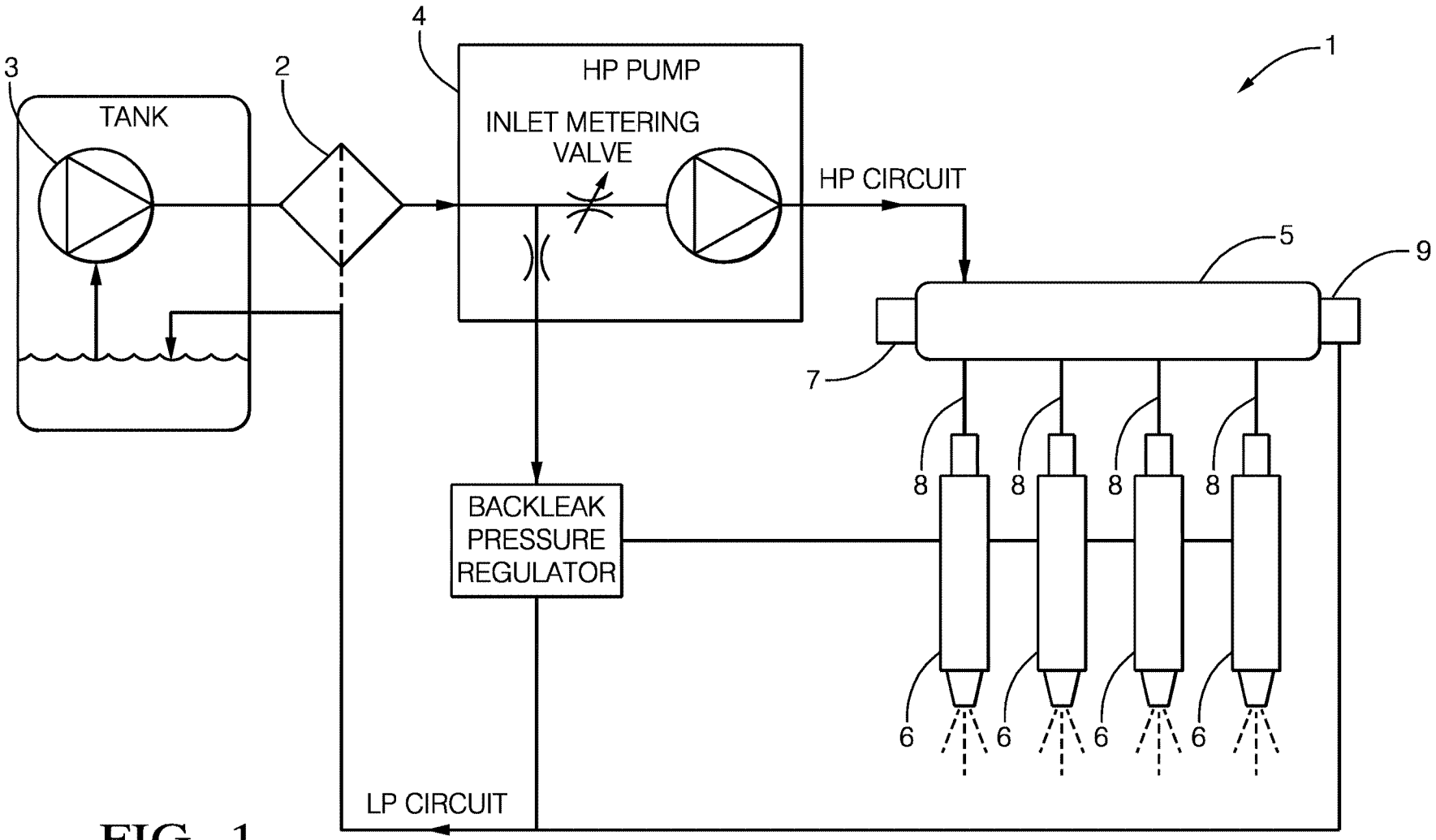
FIG. 1 shows a known fuel injection system.

FIG. 1 shows a known fuel injection system 1 for vehicles based on a common rail where fuel from a tank (not shown) passes through a filter 2 and is pressurized by low pressure pump 3 and high pressure pump 4 to an accumulator volume 5 such as a common rail which feeds fuel under high pressure to a series of injectors 6, each provided with pipes 8 from the common rail to the injectors. The pressure in the rail is controlled amongst others by a high pressure valve 9 from which forms part of a low pressure circuit back to the tank. Typically for control purposes a rail pressure sensor 7 is located at one end of the fuel rail. The disadvantages of such systems are explained above.

In alternative know systems a pressure sensor is located on the pipes between the common rail and the injectors, or integrated within the injector. This solution however requires multiple sensors, one for each injector, with specific injector design and additional wires. This leads to increased cost and complexity.

Figure 2:
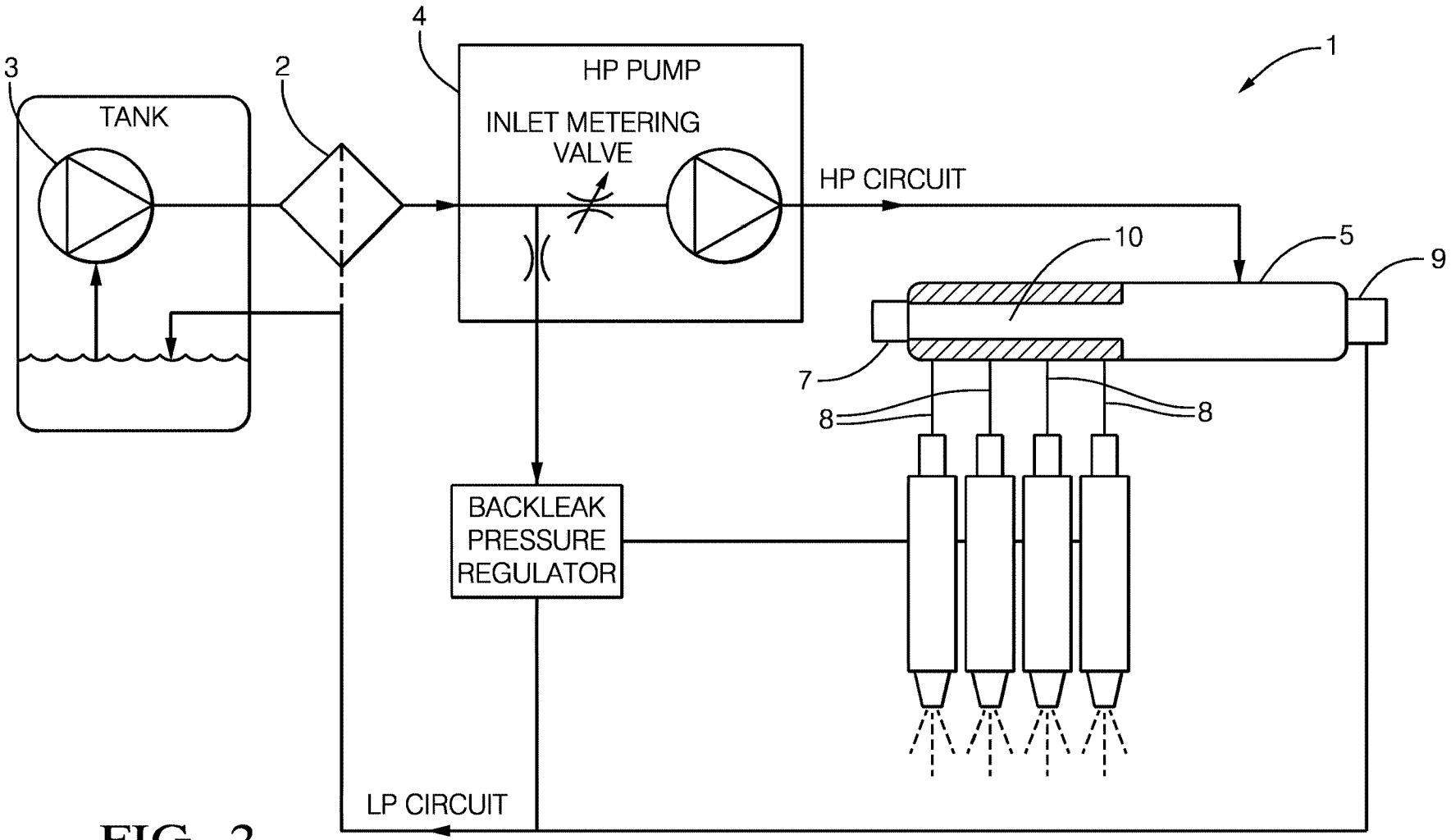
FIG. 2 shows a simple example of according to one aspect of the invention.

FIG. 2 shows a simple embodiment according to one aspect where the common rail chamber has a narrowed (pipe-like) portion 10 from which the fuel injectors are supplied, i.e. there are a number of outlets from the narrowed portion to supply fuel to corresponding individual injectors. A rail pressure sensor 7 is located within the narrow portion. By having a pressure sensor located within a narrowed chamber (conduit) portion (where the outlets are also located) improved accuracy and robustness. Reference numerals are equivalent to those of FIG. 1. The pressure signal within this narrow chamber will retain the pressure wave from the injector giving information on the injection events.

Figure 3:
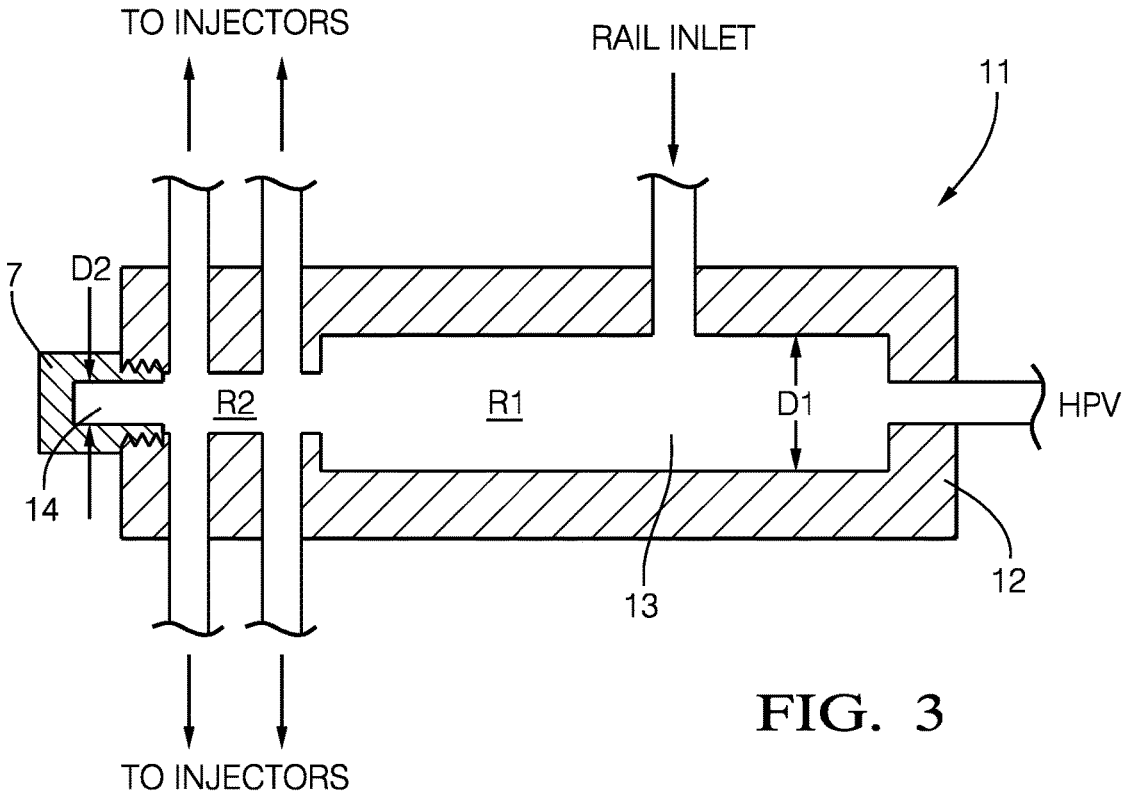
FIG. 3 shows a preferred example.

FIG. 3 shows a preferred embodiment of the invention, and an example in greater detail. The figure shows a modifies common rail or accumulator volume 11 comprising the common rail 12 housing defining a main chamber or volume 13 having a cross sectional diameter D1, to which the rail inlet is fluidly connected. At one end, the rail chamber is narrowed to provide a narrow portion 14 having a cross sectional diameter D2. Thus the common rail has a narrowed section that includes outlets to conduits (pipes) for supplying fuel to the injectors form the common rail. Within the narrow section 14 a rail pressure sensor 7 is located. A high pressure valve may be located in the wider section. Thus the narrow section 14 (internal volume) proves a narrow flow path (narrower than the main section) for fuel leaving the common rail to the injectors. This design can be considered as a "split rail" configuration and improves injection duration detection and injection quantity control. This design will allow the detection of the injection event with current single rail pressure sensor.

Thus in this examples a narrow flow passage is provided for outlet to injectors as well as a pressure sensor (mounting) to improves the ability for rail pressure sensor to detect the pressure wave caused by hydraulic injection start and end. So one option is schematically shown in FIG. 3. Preferably the rail section with narrow flow path has substantially the same diameter as the connecting pipe between the rail and the injector.

Figure 4:
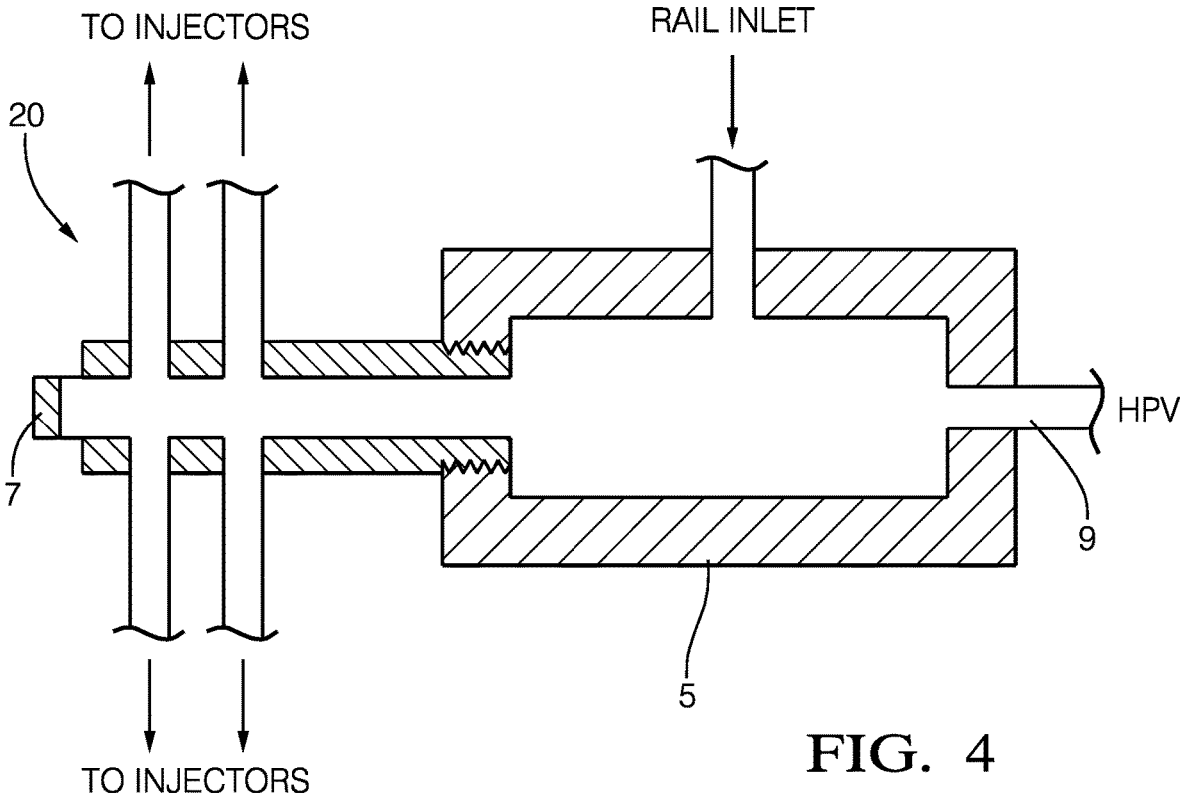
FIG. 4 shows an alternative example.

In alternative designs the common rail 5 may be connected to an auxiliary unit 20 which is fluidly connected/connectable to the common rail but is separate to the common rail and provides a flow conduit for high pressure fuel from the common rail to the fuel injectors pipes and fluidly links the common fuel rail 5 to the injectors. The auxiliary unit has a narrower cross section than the rail as shown in FIG. 4. A pressure sensor is located within the auxiliary unit. In other words this arrangement is similar to FIG. 3 except provided in two parts, and thus the auxiliary unit can be retrofitted to existing units.

Figure 5:
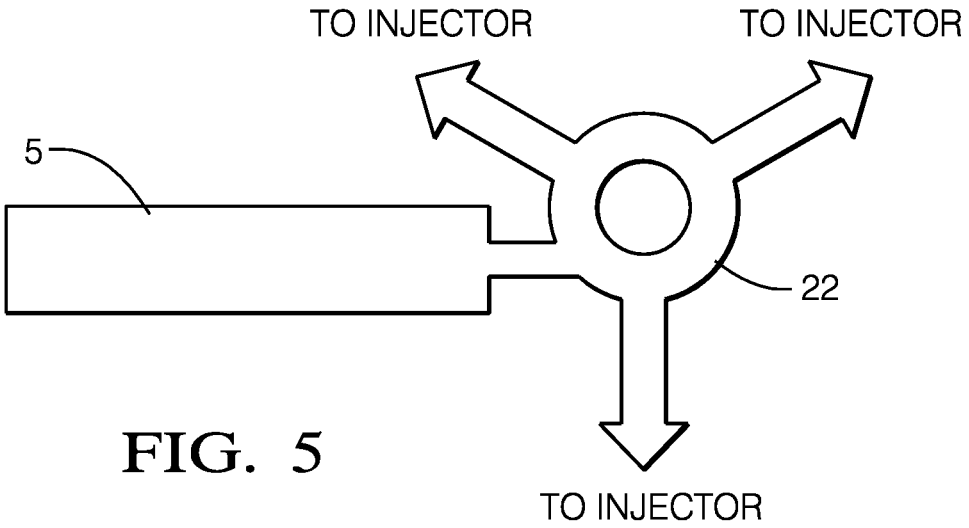
FIG. 5 shows a further alternative design according to one aspect.

FIG. 5 shows an alternative design where the common rail feeds to a ring shaped "mini" rail or torus comprising a circular (hollow) pipe 22 which is formed as a ring or torus. From the torus there are conduits (pipes) which feed the individual injectors with fuel. The pressure sensor is located in the toroid i.e. internally in the ring/toroidal rail. The internal cross section of the toroidal flow path (i.e. pipe diameter) is smaller than that of the common rail.

Figure 6:
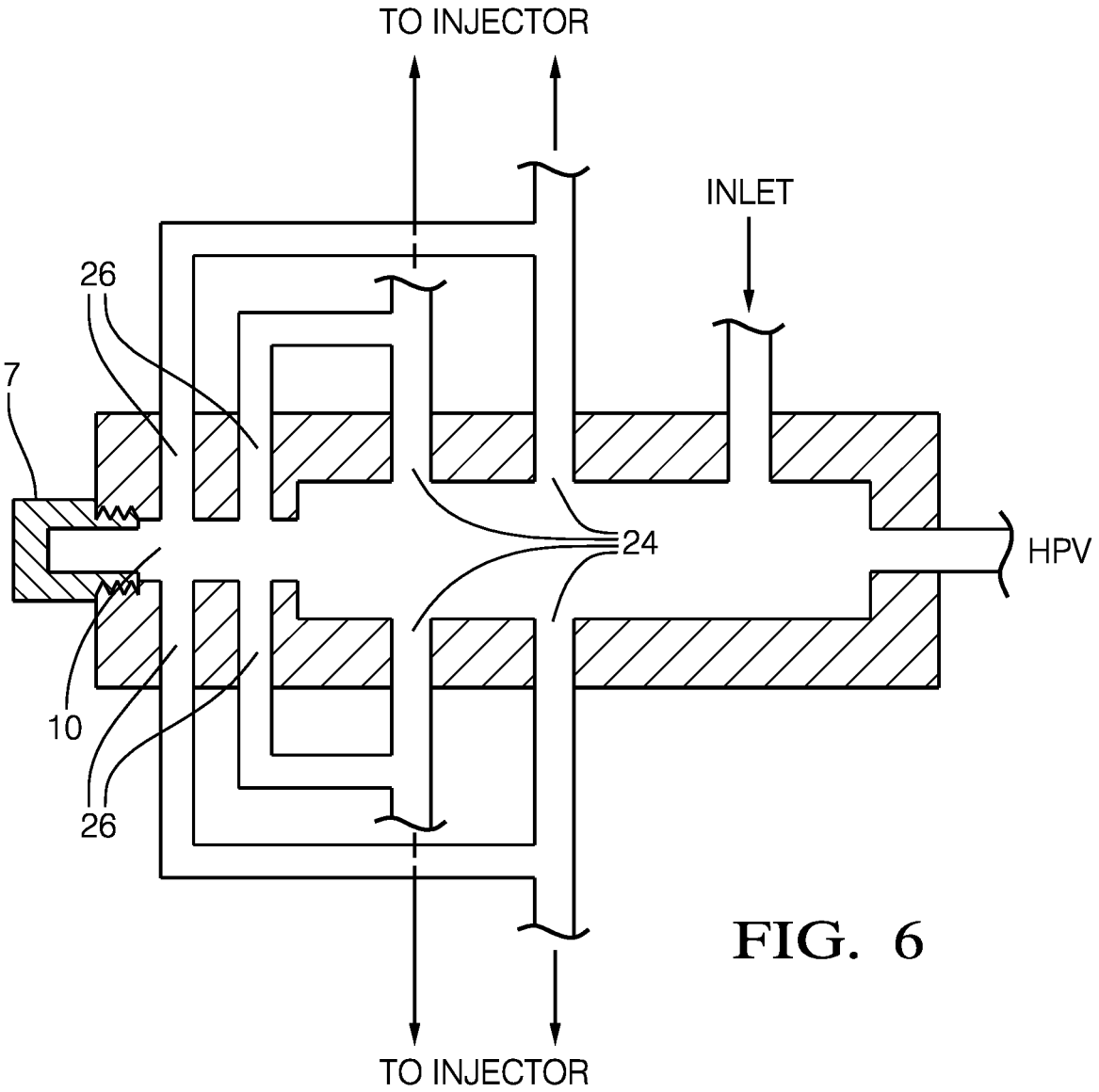
FIG. 6 shows yet a further alternative design according to one aspect.

FIG. 6 shows an alternative option where there are outlets 24 from the common rail main portion (chamber) to the injectors. Again the common rail includes a short portion with a narrow section 10 (i,e. a narrower chamber than the main section). Again the pressure sensor 7 is located in the narrow section. The outlets for each injector (24) are located in the main rail chamber for the convenience of injector mounting. For each injector a narrow fluid connection is additionally arranged to the pressure sensor. Thus there is a flow path of fuel for each injector from both the main chamber and narrowed portion (the latter by way of conduits 26). In this way, the pressure sensor will also be able to feel the injection induced pressure wave so that the pressure signal can be used for ΔP and injection duration detection.

Figure 7:
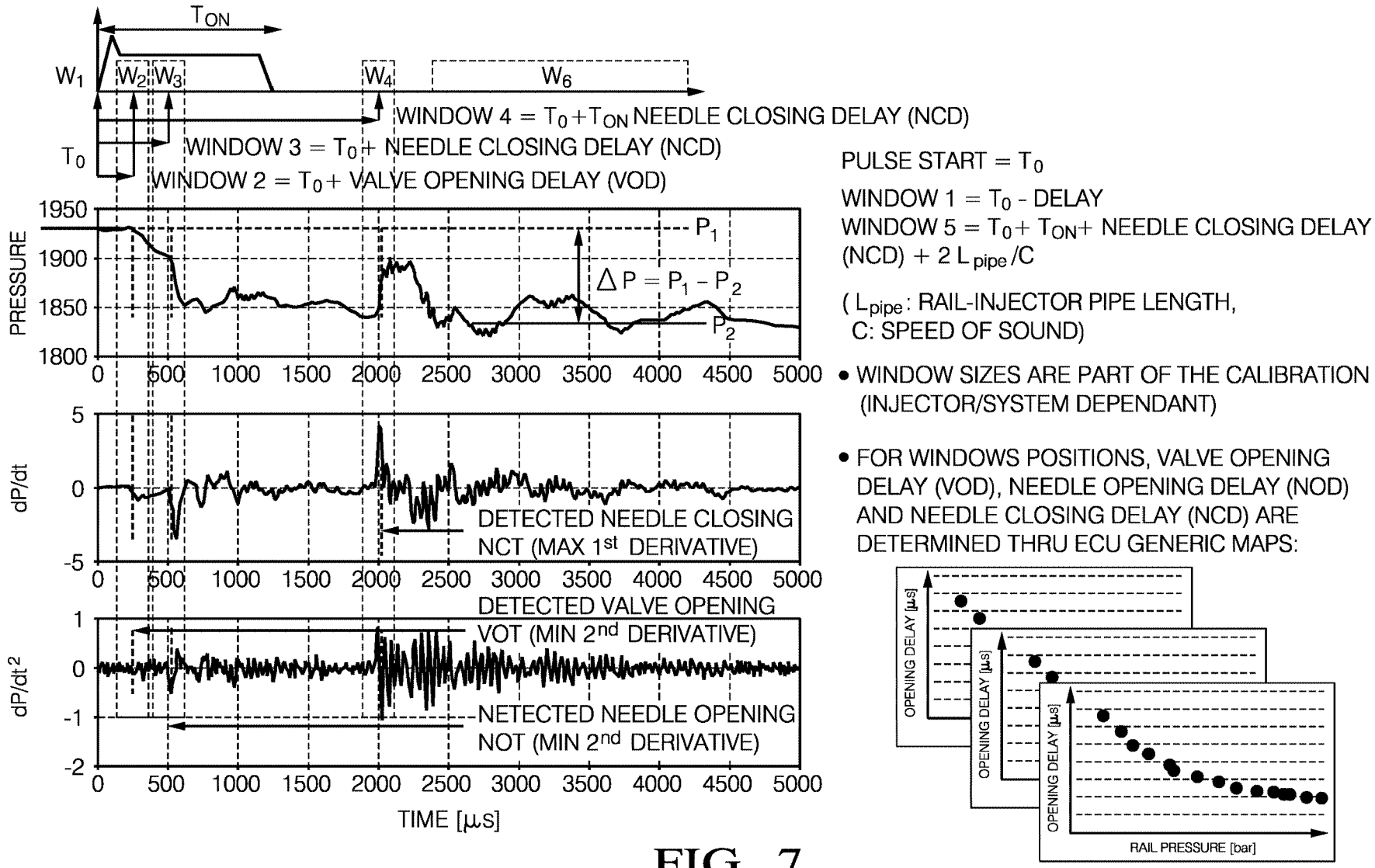
FIG. 7 shows how the pressure and it's derivatives in the common rail vary with injection.

FIG. 7 shows how the pressure in the common rail varies with injection, the top plot shows that drive pulse to a valve actuator and the plots underneath show pressure and the first and second derivatives thereof. So this figure shows a schematic illustration of windowing strategy for the detection of injection start and end and pressure drop ΔP caused by injection.

The following windowing strategy can be applied for the injection duration detection from the pressure signal from a pressure sensor located in according to any embodiment of the invention. When the control valve opens, fuel pressure starts to decrease (W2). A sharper pressure decreasing slope occurs when fuel injection starts. Therefore, the turning point in W3, i.e. the local minimum of second-order pressure time derivative, d2p/dt2, is physically corresponding to the injection start. However, it is more robust to use the local minimum of first-order derivative, dp/dt, to detect the injection starting point, because this point is well correlated to the injection start. At needle closing, the fuel flow is suddenly stopped in the injector and caused a reflecting wave. The local minimum of dp/dt is correlated with the needle closing (W4). In addition, the pressure drop ΔP is correlated to the total quantity released from the system (W1, W5).

Using pressure signals from the designs and examples of the invention such as those mention above, rail pressure signal (narrowed portion or ring/toroid portion e.g.) for injection duration detection and injection quantity can be used with increased accuracy. By putting the rail pressure sensor close to a narrow flow path or having a common rail with a narrow flow path section for injectors and sensor mounting, the rail pressure sensor can provide not only the pressure drop value corresponding to the injection quantity (compressibility principle), but also will provide data regarding the pressure wave caused by effective injection start (acceleration, momentum wave principle) and end (deceleration, momentum wave principle), and thus the injection duration can be detected by the signal from the same pressure sensor. This method does not need to add a new pressure sensor and modification of existing injector design. Hence this method has technological simplicity and advantages of easy implementation and cost saving, compared with the methods in the prior art patent publications.

So in embodiments, one single pressure sensor to detect injection starting, injection end, and deltaP, for injection quantity control for multiple cylinder's injector is used in a split-rail design/designs according to the invention. The rail configuration may consist of a first volume portion (same diameter as the conventional rail) and a smaller pipe like portion having reduced diameter (diameter similar to current high pressure injector supply pipes.

A pressure sensor located at the pipe (narrower) portion to be able to measure the pressure (acceleration/deceleration) wave caused by injection start and end for each injector for injection duration detection. The pressure sensor can also detect the ΔP linked to the injection quantity (compressibility).

Tests

Simulation investigation was carried out for the configuration of FIG. 3 using main rail (d=8.6 mm) and the reduced diameter section (d=3 mm). FIGS. 9 to 14 shows some details for the pressure signals and the windowing and detection of injection start and end for low and high quantity points at different injection pressures, 230 bar, 1200 bar, and 2000 bar.

Figure 8:
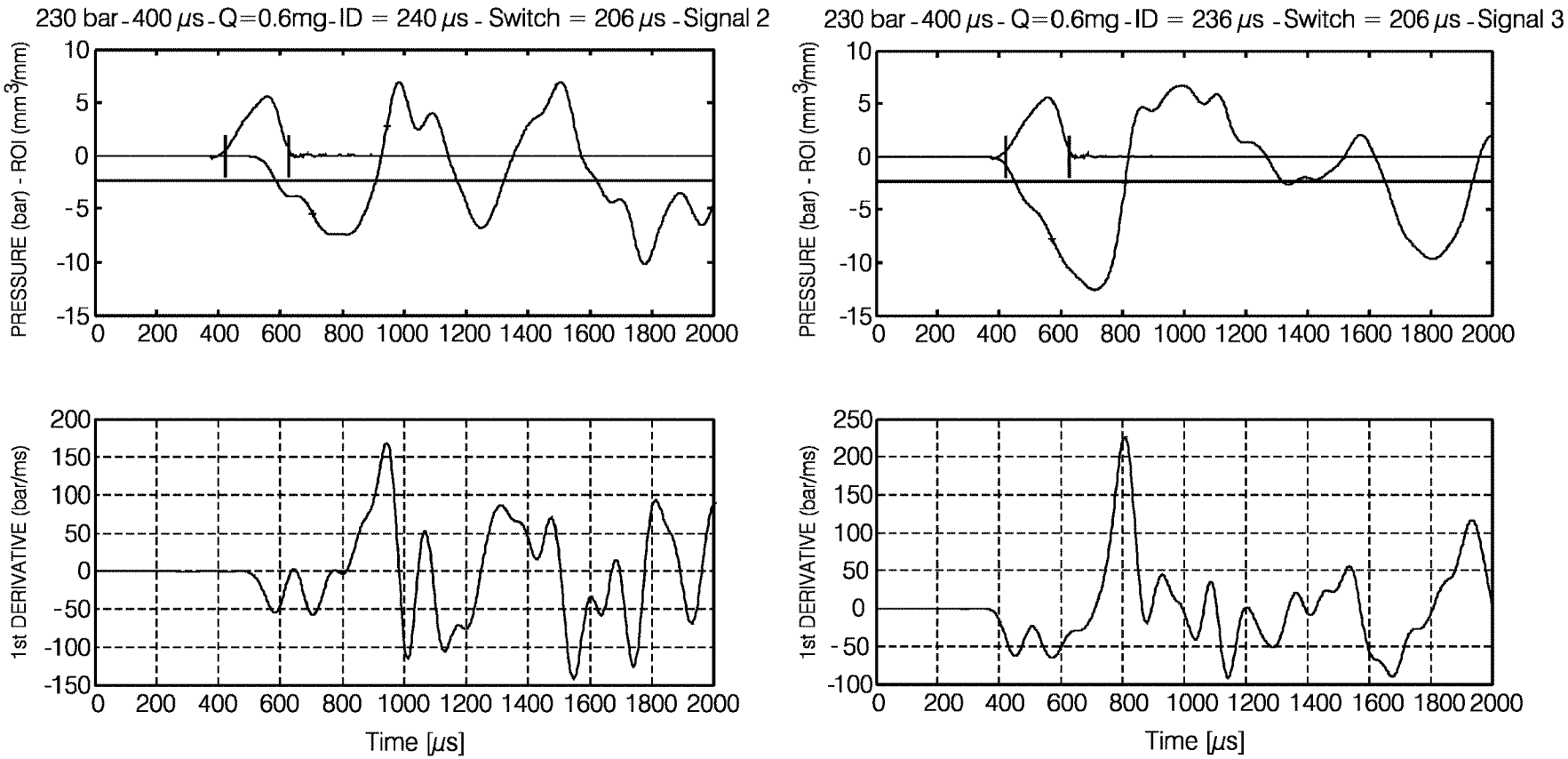
FIGS. 8 to 13 show a comparison of results from pressure sensor located in prior art arrangements (using one pressure sensor per individual injector) to an example of the invention.

FIG. 8 shows a comparison of pressure results obtained between a configuration according to an example (split rail—figure 3) (on the left) and those measured in a prior art systems from the pressure in individual pipe (pipe) connected between the common rail the injector (on the right); as well as corresponding injection start and end detections, 230 bar, 0.6 mg.

Figure 9:
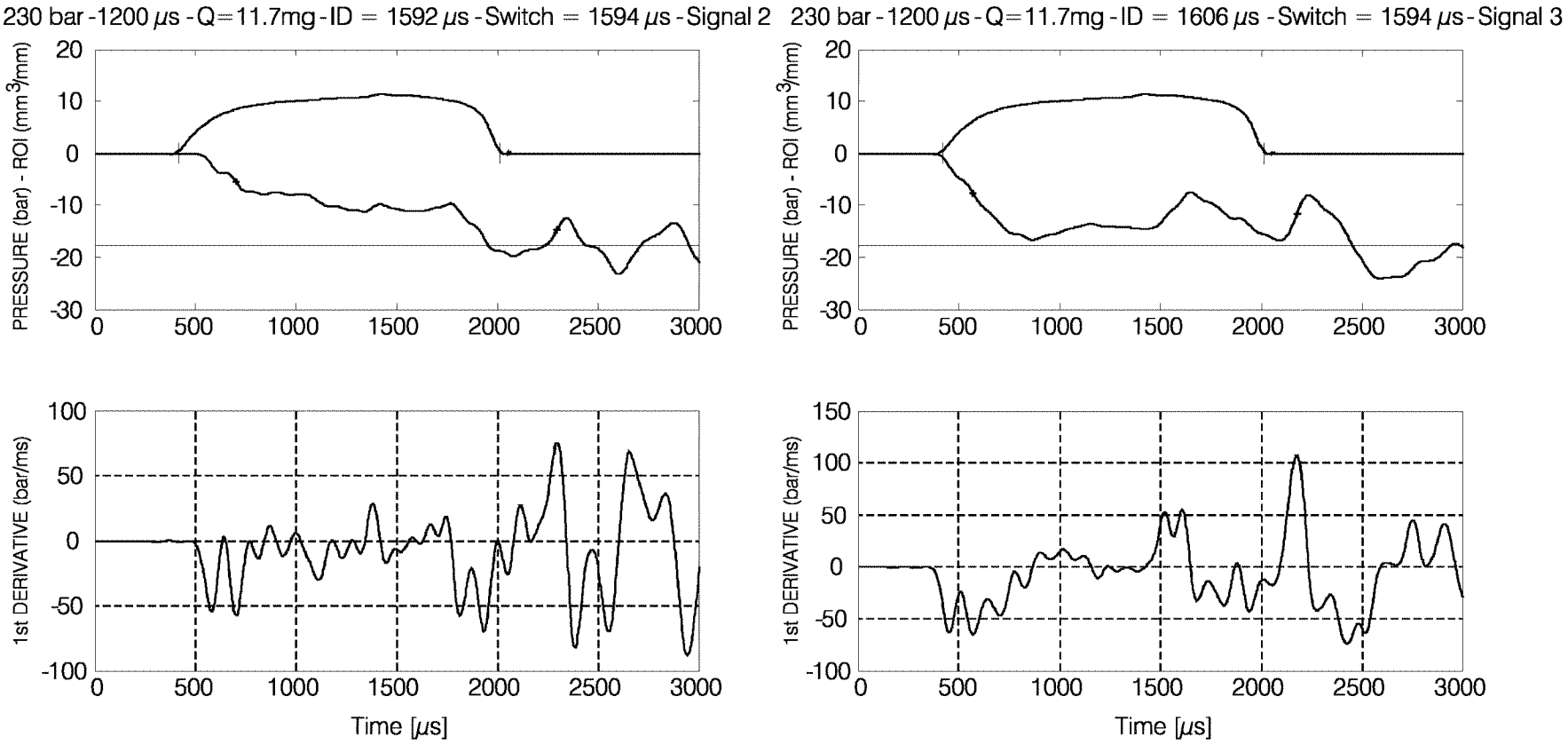

FIG. 9 shows a comparison of split rail (left) and pipe (right) pressure signals and the corresponding injection start and end detections, 230 bar, 11.7 mg.

Figure 10:
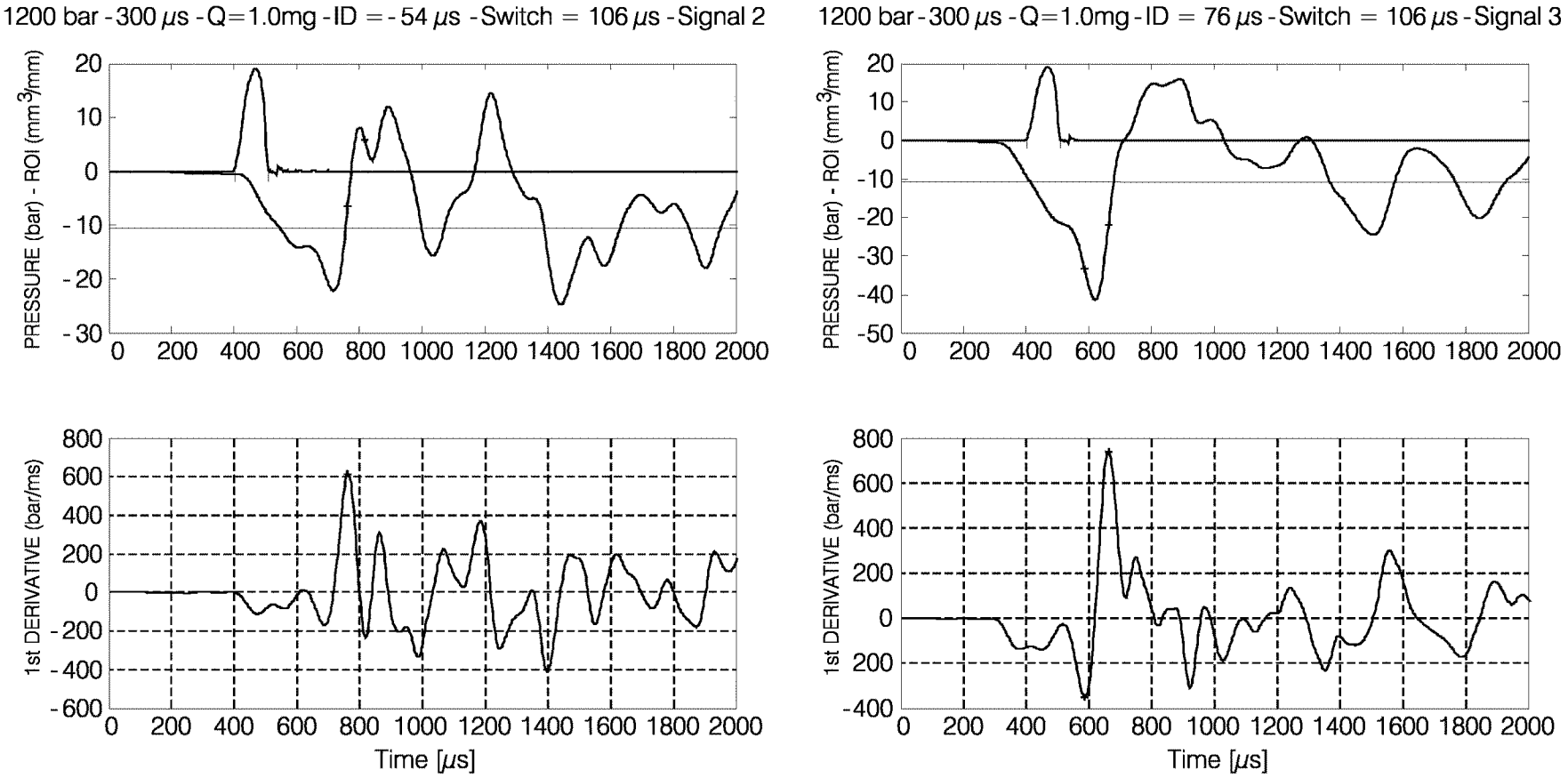

FIG. 10 shows a comparison of split rail (left) and pipe (right) pressure signal and the corresponding injection start and end detections, 1200 bar, 1.0 mg.

Figure 11:
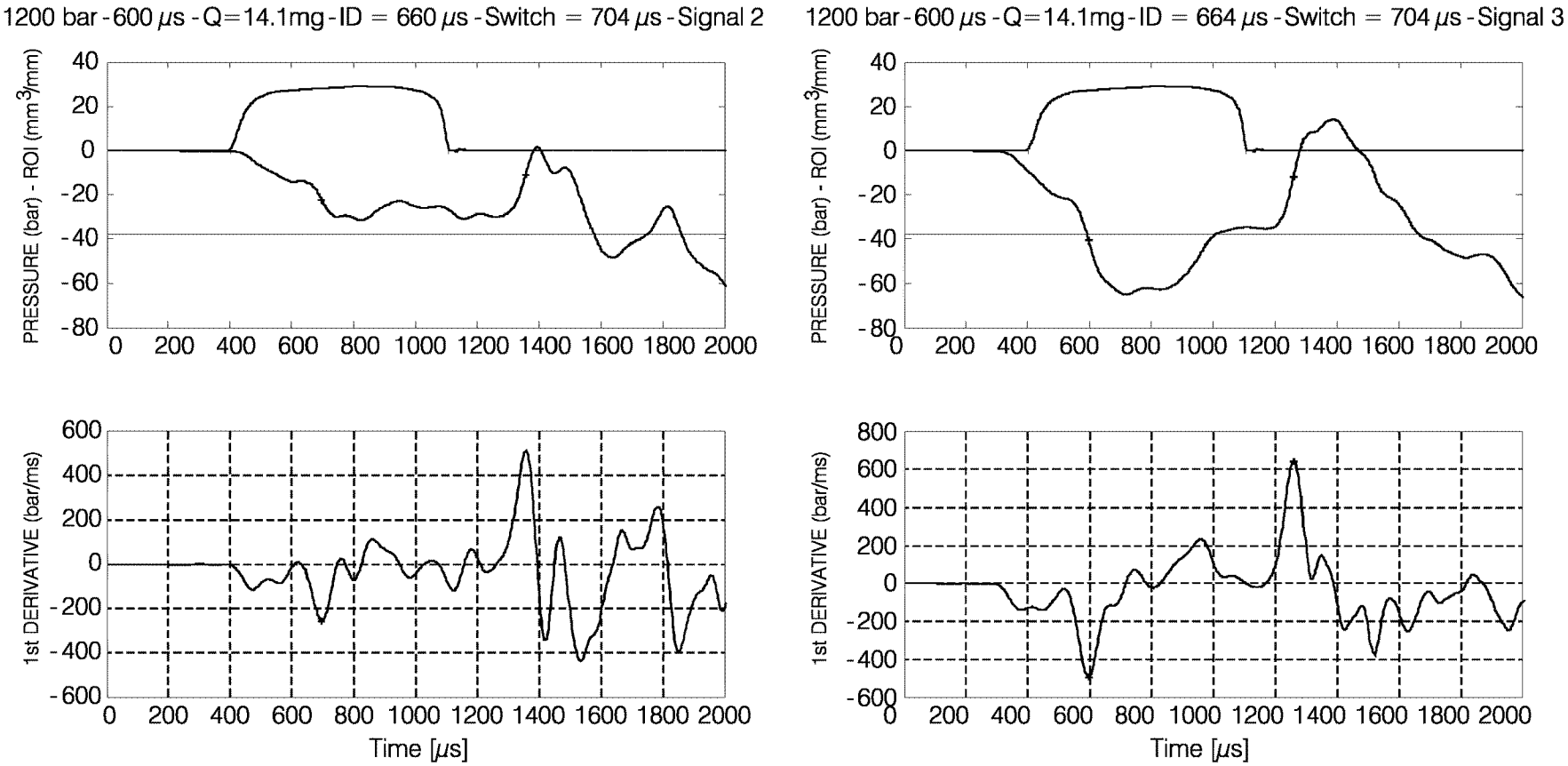

FIG. 11 shows a comparison of split rail (left) and pipe (right) pressure signals and the corresponding injection start and end detections, 1200 bar, 14.1 mg.

Figure 12:
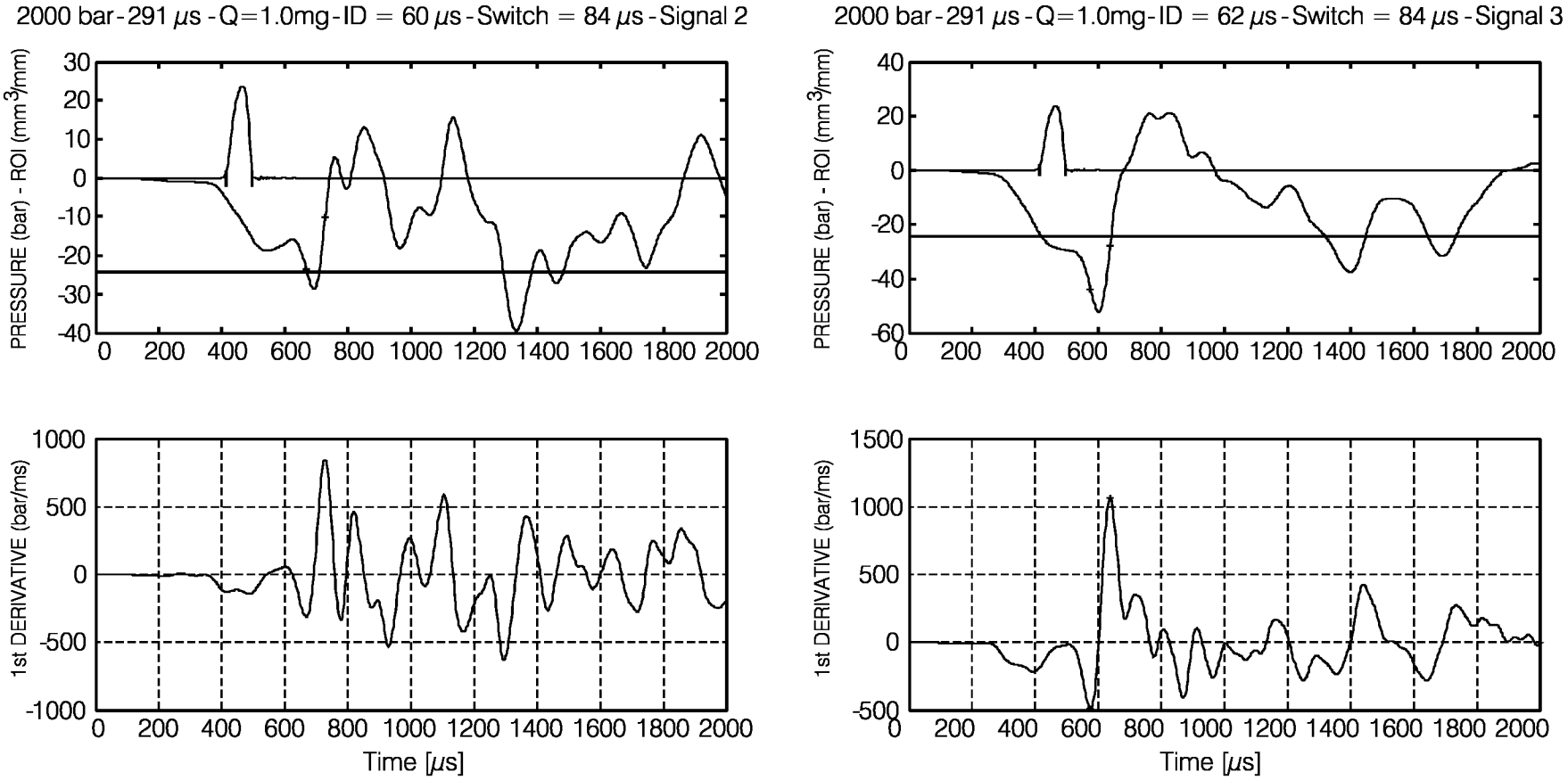

FIG. 12 shows a comparison of split rail (left) and pipe (right) pressure signals and the corresponding injection start and end detections, 2000 bar, 1.0 mg.

Figure 13:
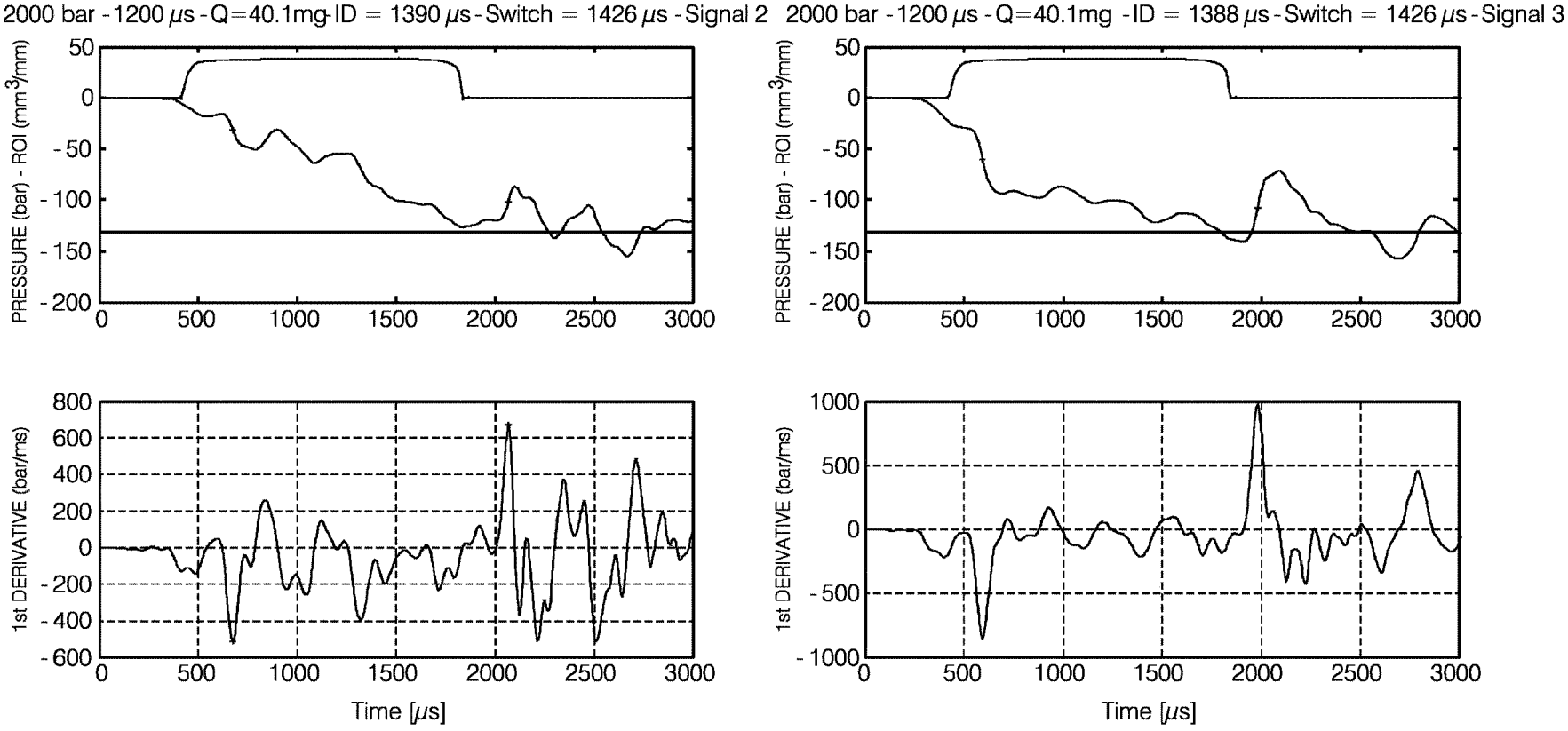

FIG. 13 shows a comparison of split rail (left) and pipe (right) pressure signals and the corresponding injection start and end detections, 2000 bar, 40.1 mg.

It is confirmed by the above simulation results that the signal intensity for the injection start and end detection from a pressure signal from a sensor located in a common rail with a narrower section (split rail) as in FIG. 3 is very comparable to the detection from individual sensors located in the pipes between the common rail and injectors (i.e. with the prior art configuration where individual sensors are located in each of the pipes which supply the injectors). Moreover, the detected injection duration from the pressure signal according to the examples of FIG. 3 (split rail) is found to be well correlated to the "Real" injection duration based on the needle switch signal.

However, the detection using the pipe/injector pressure signal needs a pressure sensor for each injector, or even need to modify the injector design, and include additional wires on the engine harness, and the detection using the configuration of FIG. 3 can be realized by using a single current pressure sensor, which already exists in the standard rail of the production FIE system.

Figure 14:
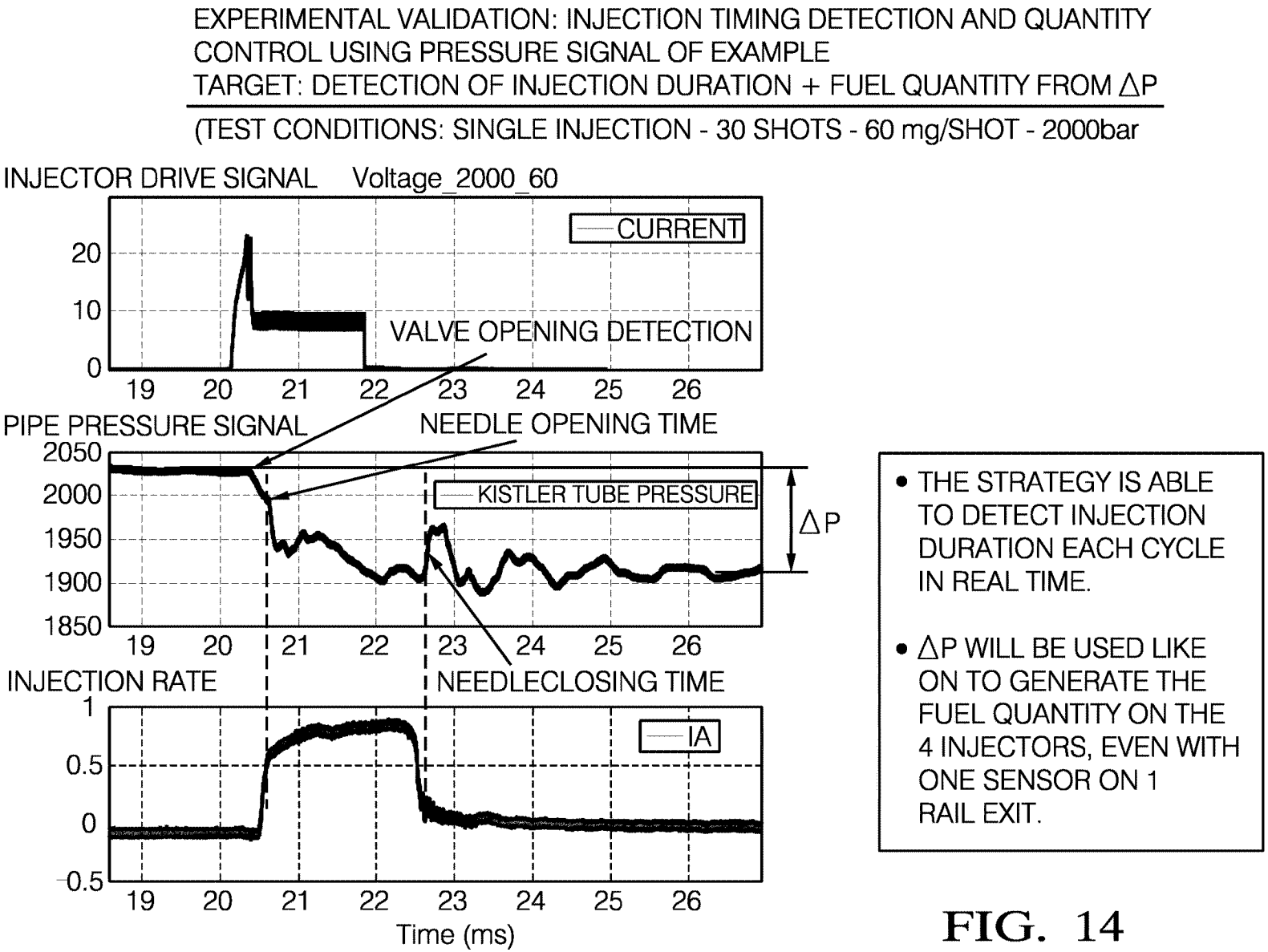
FIG. 14 shows investigations on detection capability for injection duration and ΔP using a pressure signal from one design according to the invention.

Comprehensive experimental investigations on detection capability for injection duration and ΔP using a pressure signal from one design according to the invention is shown in FIG. 14.

Figure 15:
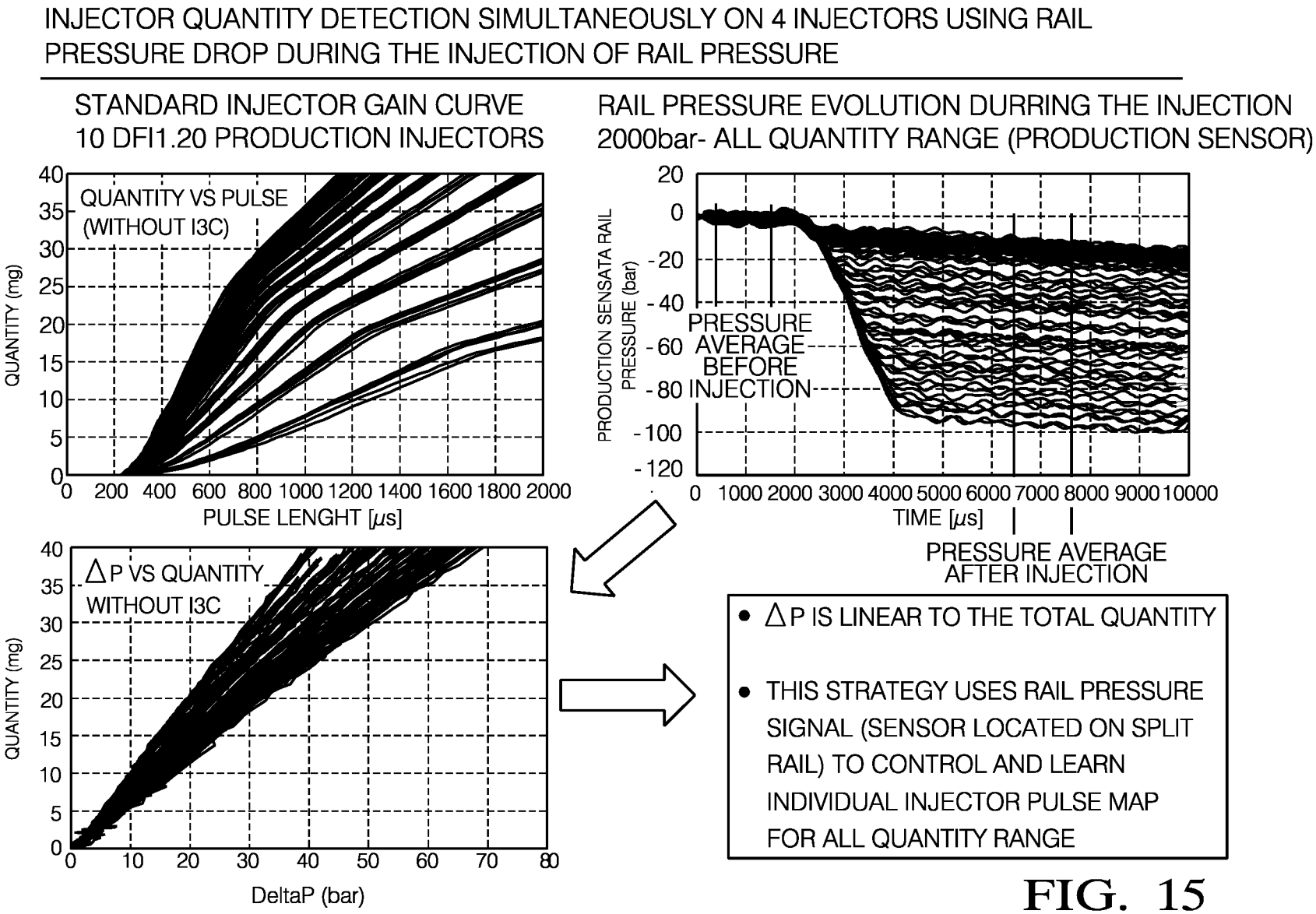
FIG. 15 shows various parameters such as quantity pulse duration and rail pressure drop, showing significant improved correlation between injection quantity and ΔP.

FIG. 15 shows various parameters such as quantity pulse duration and rail pressure drop, and this shows significant improved correlation between injection quantity and ΔP in comparison with the correlation between injection quantity and the pulse width.

Figure 16:
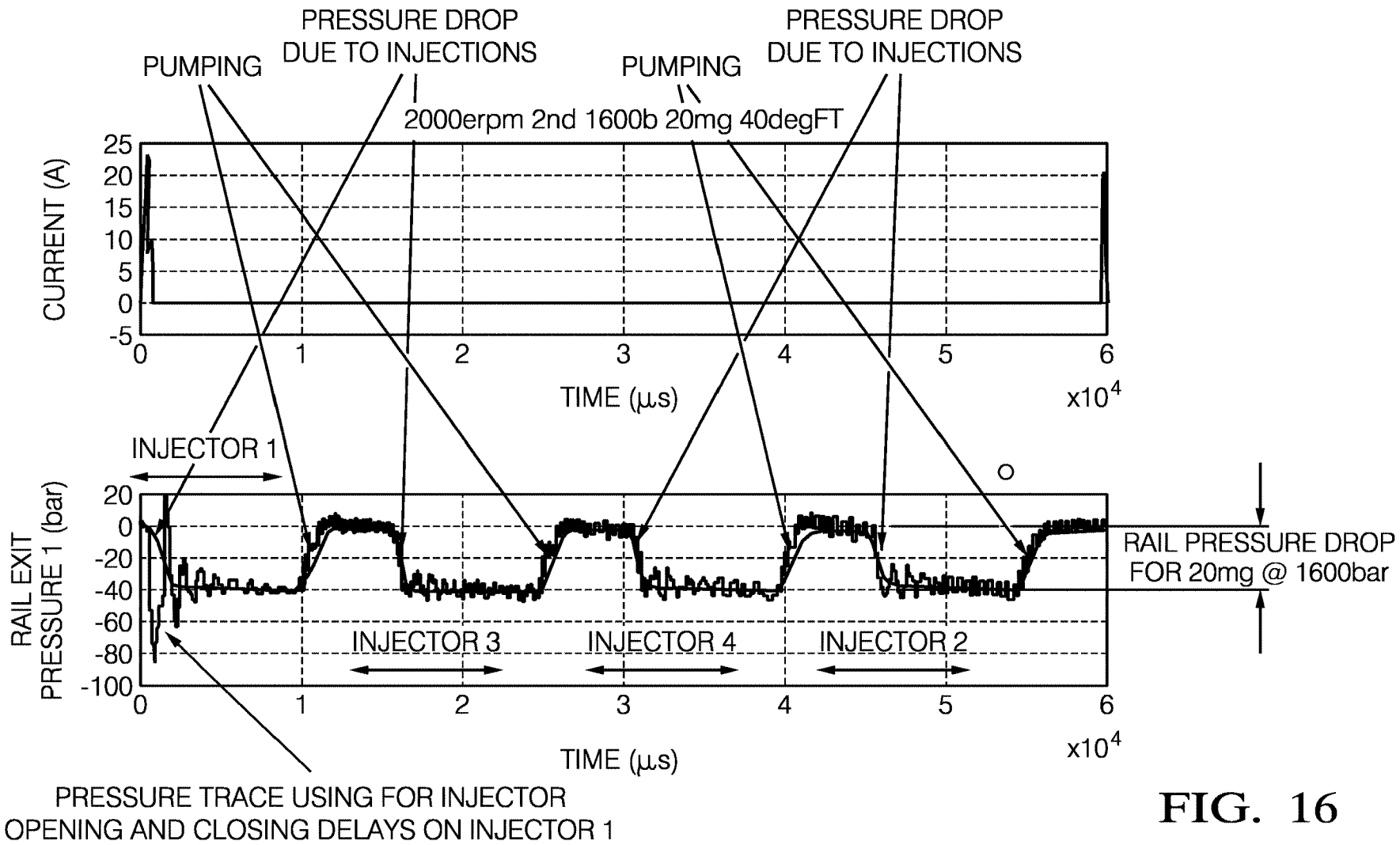
FIG. 16 shows plots of injector current and rail exit pressure for an example of the invention.

Vehicle tests have also been carried out for injection duration and ΔP detection based on designs according to aspects of the invention. In the test the rail outlet to injector 1 and the pressure sensor were located in the narrower portion of the above examples, so the injection duration for the corresponding injector is detected and in the same time ΔP have been detected for all injectors, see FIG. 16. Using designs according to the invention, both injection duration and ΔP can be detected for each active injector by using a single rail pressure sensor. As soon as both the injection duration and ΔP are detected, a correlation map for injection quantity [mg] v.s. detected injection duration [us] (ID), injection quantity vs. ΔP can be established by injector and FIE system calibration. This map will be updated at a suitable time interval in real life and used for injection control.

Figure 17A:
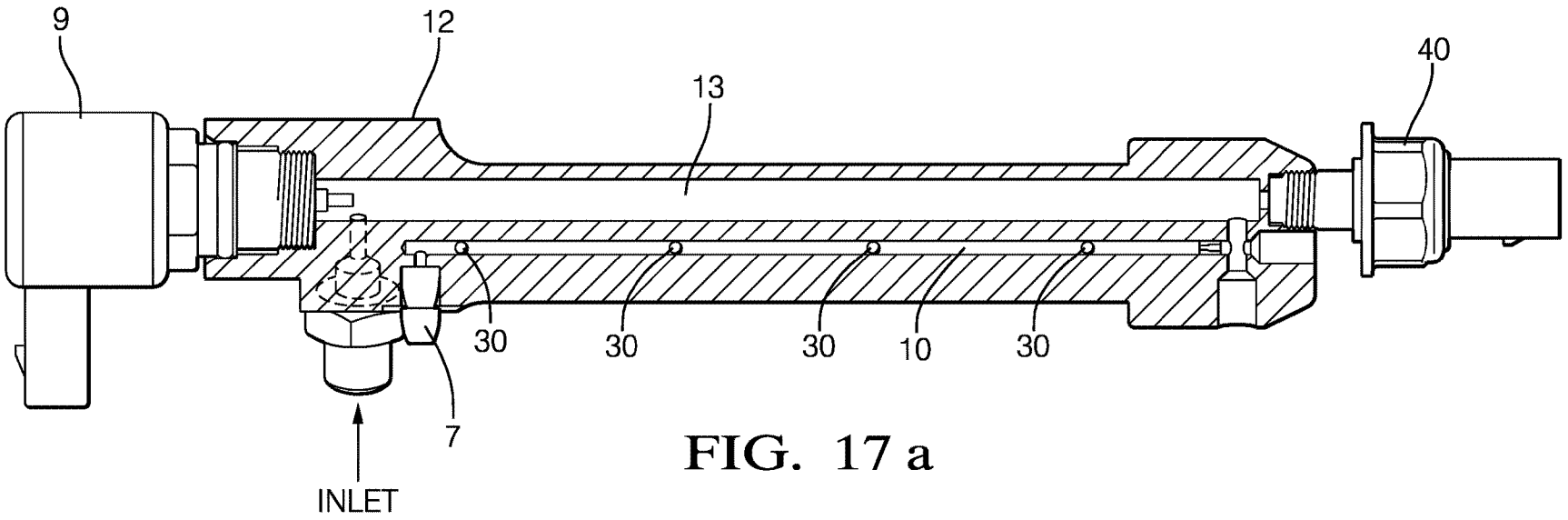
FIGS. 17*a* and 17*b* show a further example according to one embodiment.

FIGS. 17*a* and *b* shows a further example according to one embodiment. FIG. 17*a* shows across section view across a common rail 12 which incorporates a further example of the invention. An inlet is provided which provides fuel to an elongate main fuel chamber portion 13 which is thus the first portion of fluid flow path, and which runs substantially along the length of the common rail. This may be in the form of a bore of diameter D. This is fluidly connected to second portion/conduit 10 which has narrower cross section. The second portion thus forms the second portion of flow path of fuel and includes a pressure sensor 7 to sense pressure at a location in the second path. The narrower portion may comprise a bore of cross section d, d being substantially smaller than the diameter D of the main bore (first portion). Here the second portion of flow path/conduit 10 is arranged substantially parallel to the first (main portion), and the second portion runs substantially along the longitudinal path of the main portion. Thus the longitudinal axes of the first and second flow paths are parallel and substantially adjacent along their longitudinal axis portions. The term parallel can means that the longitudinal axes are within an angle of 10 degrees or less relatively to each other. Thus from the view AA the longitudinal axes would be seen as offset in this plane. This arrangement allows considerable space saving. There may be provided optionally a further pressure sensor 40 in communication with the main bore (chamber) 13.

Figure 17B:
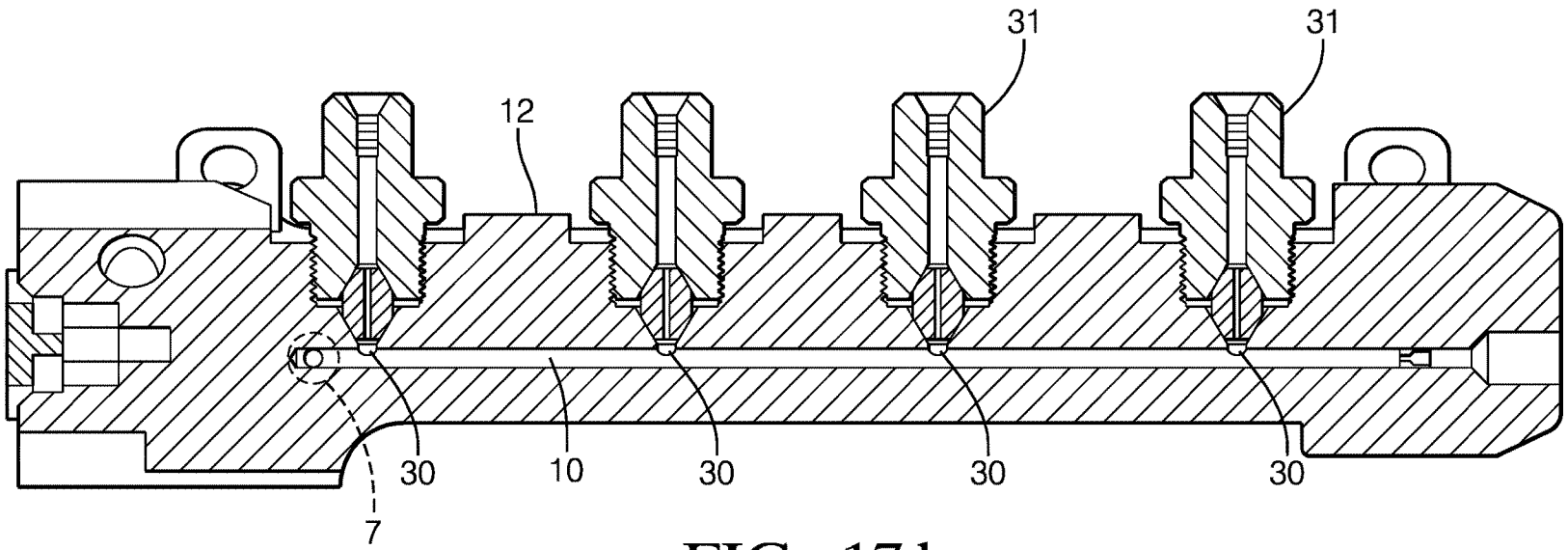

FIG. 17*b* shows a different cross section view which does not show the main fuel chamber (first flow path/conduit) 13. The narrow portion 10 (second flow path) includes (i.e. is fluidly connected to) a number of outlet ports 30 which have connections (e.g. via connectors 31) to respective fuel injectors. The location of the pressure sensor is shown in the FIG. 17*b* by reference numeral 7.

Figure 18A:
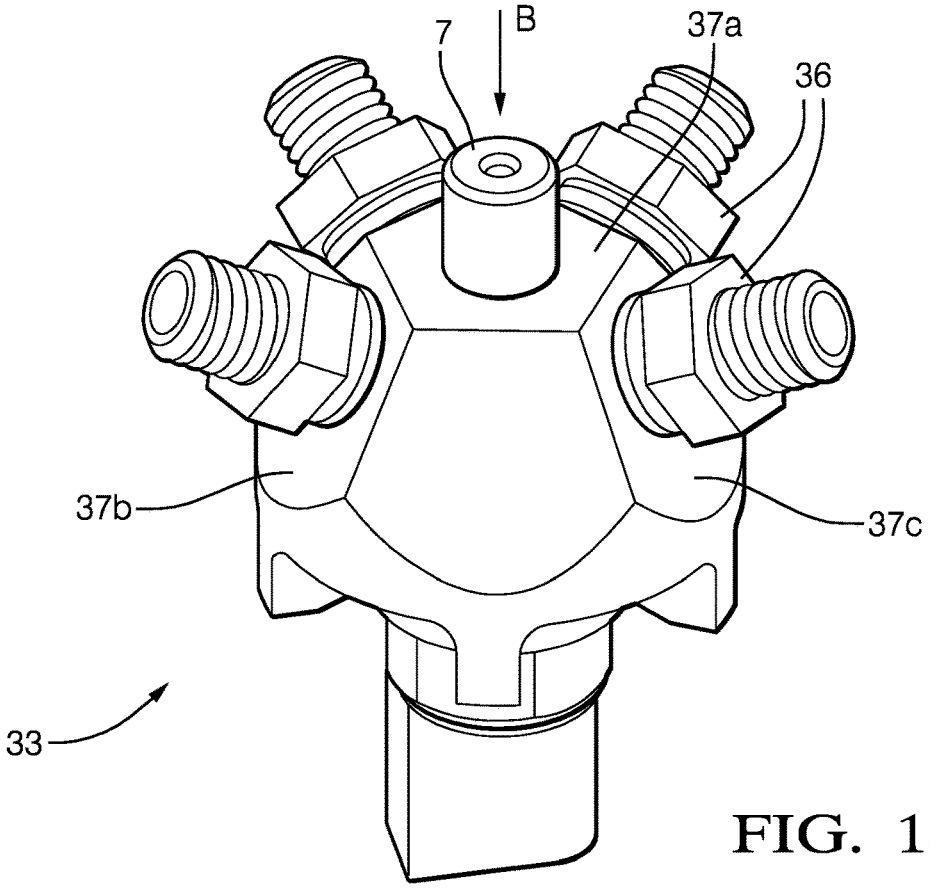
FIGS. 18*a*-18*d* show another further example according to one embodiment.

FIGS. 18*a, b, c* and *d* show views of a further embodiment. The figures show a head portion 33 which is locatable to (or part of the end of) a common rail. Thus effectively head portion is located at one end of a common rail (not shown), i.e. located at one end of a main elongate common rail chamber 13 (first portion of flow path) such that it is in fluid communication with a second portion of flow path 10 which comprises a bore (conduit) which is formed in the head portions i.e. integral with the head portion. The flow path 10 is again of a substantially lower cross section (e.g. diameter) than flow path of the main (first portion) of flow path, which could be considered to be otherwise a standard common rail elongate chamber. The conduit or bore which forms the second portion of flow path is in fluid communication with a pressure sensor 7. In addition each of a plurality of narrow channels 34 forms a confluence with the bore 10 to provide fluid communication to a number of outlets 35 in respect of fuel injectors. As can be seen form FIG. 18*b*, pipes can be connected to the outlets by way of connectors 36.

Figure 18B:
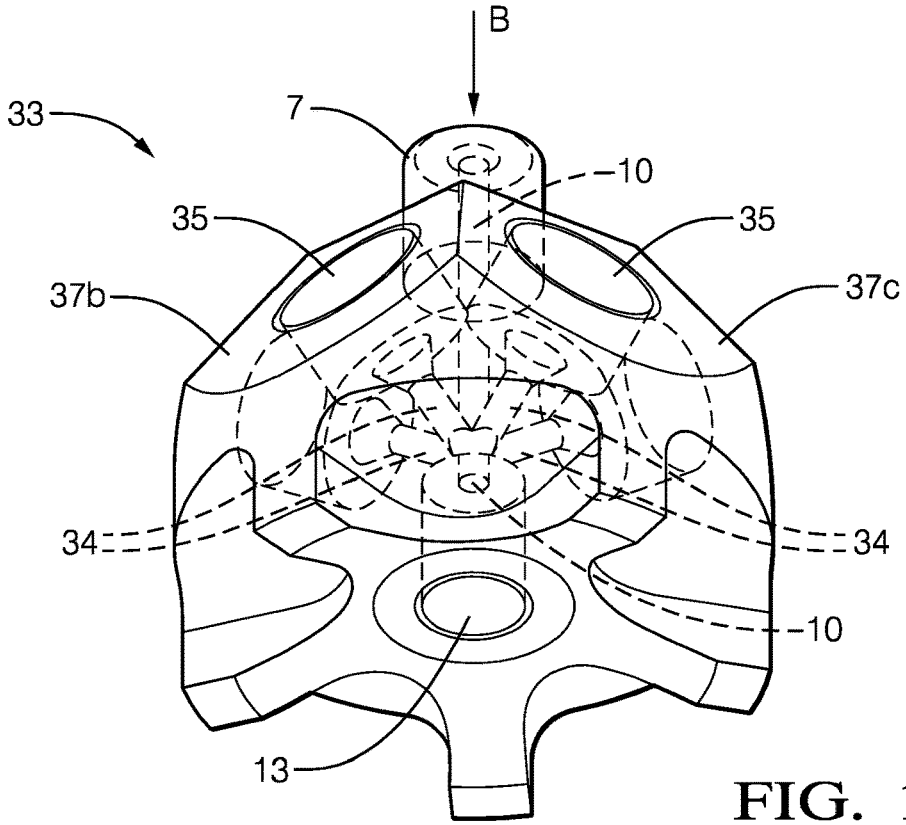
Figure 18C:
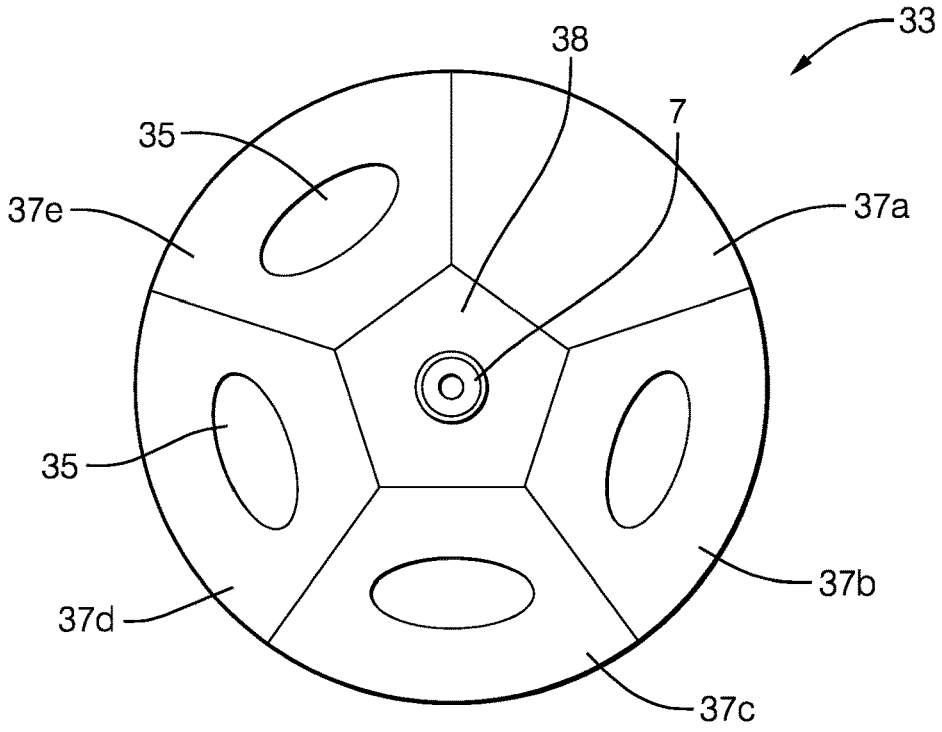
Figure 18D:
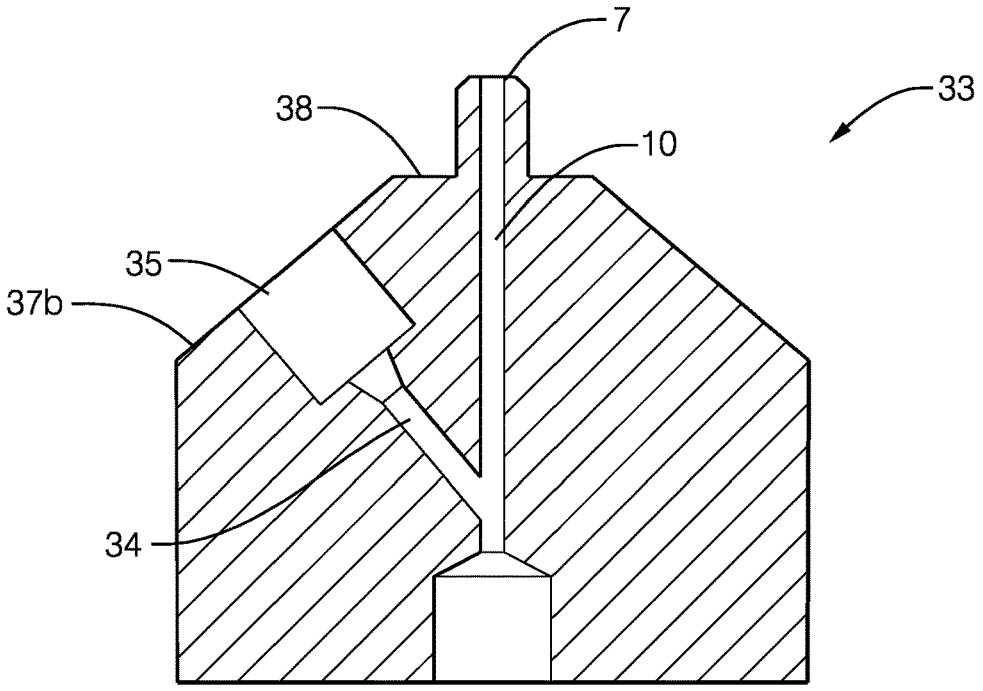

FIG. 18*c* shows a plan view of the head as seen in the in the direction of arrow B of FIGS. 18*a* and 18*b*. As can be seen the head form a polyhedron type structure with a number of faces 37. The top face 38 has a port from the narrow conduit portion 10 and which is connected the pressure sensor 7. The head includes a number of side faces 37 in example there are 5 sides faces 37*a* 37*b* 37*c* 37*d* 37*e*. Four of these side faces (37*b* 37*c* 37*d* 37*e*) include ports 35 of a like number of channels 34 which are fluidly connected to the narrow second portion of flow path 10. In the plan view the faces and thus channels 34 are asymmetrically arranged such that e.g. there is no channel whose axis in the plan view is coincident with an axis of another channel. In this way none of the channel lies directly opposite another in this plane. This has the advantage that pressure fluctuation in the pipe to a particular fuel injector has less influence with respect to the other channels. Furthermore as can be seen form FIG. 18*d* the channels 34 are arranged non perpendicular with second flow path 10.

The invention claimed is:

1. An arrangement for supplying high pressure fuel to a plurality of fuel injectors, said arrangement comprising:

a housing defining a fuel chamber, said fuel chamber provided with a flow inlet from a high pressure fuel source and forming a first portion of flow path of the fuel, said fuel chamber being fluidly connected to a conduit providing a second portion of flow path, said conduit having a plurality of outlets adapted to provide flow of high pressure fuel from said fuel chamber via said conduit to said plurality of fuel injectors via respective first outlet flow conduits, wherein said second portion of flow path is substantially narrower than said first portion of flow path, and including a pressure sensor located in or adjacent to said conduit;

wherein said housing and said fuel chamber comprise a common rail;

wherein said first outlet flow conduits are in the form of bores which form a confluence with the conduit of the second portion of flow path at a non-perpendicular angle;

wherein said first outlet flow conduits and the second portion of flow path are formed in a head, said head being located or locatable at the end of said common rail or said first portion of flow path, such that one end of the first portion of flow path or common rail is fluidly connected with said second portion of flow path; and wherein a top portion of said head is in the form of a polyhedron comprising a plurality of faces, and wherein a number of the plurality of faces include connection means and/or connection ports adapted to fix pipes from fuel injectors to be fluidly connected with said first outlet conduits.

2. An arrangement as claimed in claim 1 where said number of faces are arranged having planes which are generally perpendicular to said first outlet conduits.

3. An arrangement as claimed in claim 1 wherein said plurality of faces includes a top face having a port fluidly connected to said second portion of flow path and including means to locate or connect a pressure sensor.

4. An arrangement for supplying high pressure fuel to a plurality of fuel injectors, said arrangement comprising:

a housing defining a fuel chamber, said fuel chamber provided with a flow inlet from a high pressure fuel source and forming a first portion of flow path of the fuel, said fuel chamber being fluidly connected to a conduit providing a second portion of flow path, said conduit having a plurality of outlets adapted to provide flow of high pressure fuel from said fuel chamber via said conduit to said plurality of fuel injectors via respective first outlet flow conduits, wherein said second portion of flow path is substantially narrower than said first portion of flow path, and including a pressure sensor located in or adjacent to said conduit, where said conduit is in the form of a toroidal pipe.

5. An arrangement for supplying high pressure fuel to a plurality of fuel injectors, said arrangement comprising:

a housing defining a fuel chamber, said fuel chamber provided with a flow inlet from a high pressure fuel source and forming a first portion of flow path of the fuel, said fuel chamber being fluidly connected to a conduit providing a second portion of flow path, said conduit having a plurality of outlets adapted to provide flow of high pressure fuel from said fuel chamber via said conduit to said plurality of fuel injectors via respective first outlet flow conduits, wherein said second portion of flow path is substantially narrower than said first portion of flow path, and including a pressure sensor located in or adjacent to said conduit;

wherein said fuel chamber includes a plurality of respective second flow conduits for said plurality of fuel injectors, each one of said plurality of respective second flow conduits fluidly connected with a respective one of said first outlet flow conduits and forming a confluence therewith.

6. An arrangement for supplying high pressure fuel to a plurality of fuel injectors, said arrangement comprising:

a housing defining a fuel chamber, said fuel chamber provided with a flow inlet from a high pressure fuel source and forming a first portion of flow path of the fuel, said fuel chamber being fluidly connected to a conduit providing a second portion of flow path, said conduit having a plurality of outlets adapted to provide flow of high pressure fuel from said fuel chamber via said conduit to said plurality of fuel injectors via respective first outlet flow conduits, wherein said second portion of flow path is substantially narrower than said first portion of flow path, and including a pressure sensor located in or adjacent to said conduit;

wherein said first portion of flow path and said second portion of flow path are arranged as substantially parallel and adjacent bores and such that they overlap substantially along their longitudinal axes.

* * * * *